US006698924B2

(12) United States Patent
McCarthy, Jr. et al.

(10) Patent No.: US 6,698,924 B2
(45) Date of Patent: Mar. 2, 2004

(54) COOLING SYSTEM COMPRISING A CIRCULAR VENTURI

(75) Inventors: Joseph H. McCarthy, Jr., Dayton, OH (US); Hoa Dao Pham, Xenia, OH (US)

(73) Assignee: Tank, Inc., Dayton, OH (US)

( * ) Notice: Subject to any disclaimer, the term of this patent is extended or adjusted under 35 U.S.C. 154(b) by 0 days.

(21) Appl. No.: 10/045,690

(22) Filed: Jan. 12, 2002

(65) Prior Publication Data

US 2002/0121105 A1 Sep. 5, 2002

Related U.S. Application Data

(63) Continuation-in-part of application No. 09/745,588, filed on Dec. 21, 2000.

(51) Int. Cl.[7] ..... H01J 35/10

(52) U.S. Cl. ..... 378/200; 415/208.1; 417/178; 417/295

(58) Field of Search ..... 378/130, 141, 378/199, 200; 137/565.22; 417/279, 295; 415/196, 206, 208.1

(56) References Cited

U.S. PATENT DOCUMENTS

| | | | |
|---|---|---|---|
| 2,265,108 | A | 12/1941 | Berman |
| 3,584,440 | A | 6/1971 | Vigil |
| 4,019,983 | A | 4/1977 | Mandt |
| 4,136,565 | A | 1/1979 | Migrin et al. |

(List continued on next page.)

FOREIGN PATENT DOCUMENTS

| | | |
|---|---|---|
| JP | 4248414 | 9/1992 |
| WO | WO 99/31441 | 6/1999 |

OTHER PUBLICATIONS

"W.E. Anderson Duotech Pressure Switches/Flotech Pressure Switches/Midwest Sight Flow Indicators/Conductivity Controls Shoe Testers," 6/97, Bulletin J–20, Dwyer Instruments, Inc., Michigan City, IN USA.

"QuikPiks Gems Stock Products Catalog," pp. 32–33, Gems Sensors Catalog No. 600, Gems Sensors, Inc., Plainville, CT USA.

(List continued on next page.)

*Primary Examiner*—Edward J. Glick
*Assistant Examiner*—Allen C. Ho
(74) *Attorney, Agent, or Firm*—Jacox Meckstroth & Jenkins

(57) ABSTRACT

A system and method for improving cooling of a heat-generating component in a closed-loop cooling system is shown. The system comprises a venturi having a throat which is coupled to an expansion tank that is exposed to atmospheric pressure in the embodiment being described. The venturi, when used with a pressure switch, can operate to determine a flow rate which can be used to generate a signal which in turn is used to activate or deactivate one or more of the components, such as the heat-generating component, in the system. Also shown is another embodiment wherein a circular venturi is provided to permit a venturi passageway to be defined about an axis of the pump in order to shorten the overall length of the pump and venturi combination.

55 Claims, 8 Drawing Sheets

U.S. PATENT DOCUMENTS

| | | | | |
|---|---|---|---|---|
| 4,250,715 | A | | 2/1981 | Ratliff |
| 4,282,172 | A | | 8/1981 | McKnight |
| 4,308,835 | A | | 1/1982 | Abbey |
| 4,367,194 | A | | 1/1983 | Schenewerk et al. |
| 4,387,685 | A | | 6/1983 | Abbey |
| 4,471,907 | A | | 9/1984 | Gerstmann |
| 4,739,153 | A | | 4/1988 | Rendel et al. |
| 4,927,337 | A | | 5/1990 | Lustwerk |
| 4,954,321 | A | | 9/1990 | Jensen |
| 5,043,104 | A | | 8/1991 | Stirling |
| 5,085,809 | A | | 2/1992 | Stirling |
| 5,088,896 | A | * | 2/1992 | Nielsen et al. ..... 417/178 |
| 5,220,940 | A | | 6/1993 | Palmer |
| 5,410,991 | A | | 5/1995 | Beaudry et al. |
| 5,509,463 | A | | 4/1996 | Callaway |
| 5,676,173 | A | | 10/1997 | Conrad et al. |
| 5,880,378 | A | | 3/1999 | Berhring, II |
| 5,890,880 | A | | 4/1999 | Lustwerk |
| 5,934,328 | A | | 8/1999 | Conrad et al. |

OTHER PUBLICATIONS

"Lytron 1997 Catalog Total Thermal Solutions," pp. 12–15 and 26–29, 1997, Lytron, Inc., Woburn, MA USA.

"Product Guide," pp. 1 and 14, 2/97, Comair Rotron, San Ysidro, CA USA.

"The Heart of the System Global Tube & Detector, Electric Avenue Manufacuring Operations," GE Handout, pp. 1–9.

Toboldt, William, "Chapter 15 Engine Cooling Systems," Automotive Encyclopedia, 1995, pp. 189–207, Goodheart Willcox Co.

* cited by examiner 44
38
42a
45
49
10
42b
42
46
22
22a
28
32
40
34
26
36
30
50
ECU
18
16
14
12
20

FIG-5

TABLE IV

| D6 Inch | D11/D6 Inch | D11 Inch | Area Sq Inch | Area Sq Ft | Flow GPM | Flow Cu Ft/Sec | Velocity Ft/Sec | Pressure Rise Ft of Water | Pressure Rise PSIG |
|---|---|---|---|---|---|---|---|---|---|
| 0.5 | 0.322 | 0.161 | 0.020 | 0.0001 | 1 | 0.0022 | 15.76 | 3.86 | 1.68 |
| 0.5 | 0.322 | 0.161 | 0.020 | 0.0001 | 2 | 0.0045 | 31.52 | 15.43 | 6.70 |
| 0.5 | 0.322 | 0.161 | 0.020 | 0.0001 | 3 | 0.0067 | 47.28 | 34.71 | 15.08 |
| 0.5 | 0.322 | 0.161 | 0.020 | 0.0001 | 4 | 0.0089 | 63.04 | 61.71 | 26.80 |
| 0.5 | 0.322 | 0.161 | 0.020 | 0.0001 | 5 | 0.0111 | 78.80 | 96.42 | 41.88 |
| 0.5 | 0.322 | 0.161 | 0.020 | 0.0001 | 6 | 0.0134 | 94.56 | 138.85 | 60.31 |
| 0.5 | 0.375 | 0.1875 | 0.028 | 0.0002 | 1 | 0.0022 | 11.62 | 2.10 | 0.91 |
| 0.5 | 0.375 | 0.1875 | 0.028 | 0.0002 | 2 | 0.0045 | 23.24 | 8.39 | 3.64 |
| 0.5 | 0.375 | 0.1875 | 0.028 | 0.0002 | 3 | 0.0067 | 34.86 | 18.87 | 8.20 |
| 0.5 | 0.375 | 0.1875 | 0.028 | 0.0002 | 4 | 0.0089 | 46.48 | 33.55 | 14.57 |
| 0.5 | 0.375 | 0.1875 | 0.028 | 0.0002 | 5 | 0.0111 | 58.10 | 52.42 | 22.77 |
| 0.5 | 0.375 | 0.1875 | 0.028 | 0.0002 | 6 | 0.0134 | 69.72 | 75.48 | 32.78 |
| 0.5 | 0.375 | 0.1875 | 0.028 | 0.0002 | 7 | 0.0156 | 81.34 | 102.74 | 44.62 |
| 0.5 | 0.402 | 0.201 | 0.032 | 0.0002 | 1 | 0.0022 | 10.11 | 1.59 | 0.69 |
| 0.5 | 0.402 | 0.201 | 0.032 | 0.0002 | 2 | 0.0045 | 20.22 | 6.35 | 2.76 |
| 0.5 | 0.402 | 0.201 | 0.032 | 0.0002 | 3 | 0.0067 | 30.34 | 14.29 | 6.21 |
| 0.5 | 0.402 | 0.201 | 0.032 | 0.0002 | 4 | 0.0089 | 40.45 | 25.40 | 11.03 |
| 0.5 | 0.402 | 0.201 | 0.032 | 0.0002 | 5 | 0.0111 | 50.56 | 39.69 | 17.24 |
| 0.5 | 0.402 | 0.201 | 0.032 | 0.0002 | 6 | 0.0134 | 60.67 | 57.16 | 24.82 |
| 0.5 | 0.402 | 0.201 | 0.032 | 0.0002 | 7 | 0.0156 | 70.78 | 77.80 | 33.79 |
| 1.6 | 0.399 | 0.6381 | 0.320 | 0.0022 | 60 | 0.1337 | 60.20 | 56.27 | 24.44 |

LIQUID-TO-AIR EXCHANGER
102
100
104
106
108
HEAT REJECTION COMPONENT
HEAT REGENERATING COMPONENT
SECONDARY FLUID
VENTURI AND SWITCH
49
PRIMARY FLUID

COOLING SYSTEM COMPRISING A CIRCULAR VENTURI

RELATED APPLICATION

This application is a continuation-in-part of U.S. patent application Ser. No. 09/745,588 filed Dec. 21, 2000.

BACKGROUND OF THE INVENTION

1. Field of the Invention

This invention relates to a cooling system, and more particularly, it relates to a venturi used in a closed-loop cooling system to facilitate cooling a heat-generating component by raising the pressure of the fluid in the system and, therefore, the boiling point of the fluid, with the increased pressure establishing that there is flow in the closed-loop system.

2. Description of the Prior Art

In many prior art cooling systems, the fluid is absorbing heat from a heat-generating component. The fluid is conveyed to a heat exchanger, which dissipates the heat, and the fluid is then recirculated to the heat-generating component. The size of the heat exchanger is directly related to the amount of heat dissipation required. For example, in a typical X-ray system, an X-ray tube generates a tremendous amount of heat on the order of 1 KW to about 10 KW. The X-ray tube is typically cooled by a fluid that is pumped to a conventional heat exchanger where it is cooled and then pumped back to the heat-generating component.

In the past, if a flow rate of the fluid fell below a predetermined flow rate, the temperature of the fluid in the system would necessarily increase to the point where the fluid in the system would boil or until a limit control would turn the heat-generating component off. This boiling would sometimes cause cavitation in the pump.

The increase in temperature of the fluid could also result in the heat-generating component not being cooled to the desired level. This could either degrade or completely ruin the performance of the heat-generating component altogether.

In the typical system of the past, a flow switch was used to turn the system off when the flow rate of the fluid became too low. FIG. 6 is a schematic illustration of a venturi which will be used to describe a conventional manner of measuring the flow rate. Referring to FIG. 6, the velocity at point B is higher than at either of sections A, and the pressure (measured by the difference in level in the liquid in the two legs of the U-tube at B) is correspondingly lower.

Since the difference in pressure between B and A depends on the velocity, it must also depend on the quantity of fluid passing through the pipe per unit of time (flow rate in cubic feet/second equals cross-sectional area of pipe in $ft^2\times$ the velocity in ft./second). Consequently, the pressure difference provided a measure for the flow rate. In the gradually tapered portion of the pipe downstream of B, the velocity of the fluid is reduced and the pressure in the pipe restored to the value it had before passing through the construction. A pressure differential switch would be attached to the throat and an end of the venturi to generate a flow rate measurement. This measurement would then be used to start or shut the heat-generating component down.

In the past, a conventional pressure differential switch measured this pressure difference in order to provide a correlating measurement of the fluid flow rate in the system. The flow rate would then be used to control the operation of the heat- generating component, such as an X-ray tube.

Unfortunately, the pressure differential switch of the type used in these types of cooling systems of the past and described earlier herein are expensive and require additional care when coupling to the venturi. The pressure differential switches of the past were certainly more expensive than a conventional pressure switch which simply monitors a pressure at a given point in a conduit in the closed-loop system.

Another problem with the venturis of the past is that they were typically situated in line in a cooling system which caused the overall dimensions of the cooling system or portion thereof to increase because of the axial length of the venturi.

What is needed, therefore, is a system and method that facilitates using low-cost components, such as a non-differential pressure switch (rather than a differential pressure switch), which also provides a means for increasing pressure in the closed-loop system.

SUMMARY OF THE INVENTION

It is, therefore, a primary object of the invention to provide a system and method for improving cooling of a heat-generating component, such as an X-ray tube in an X-ray system.

Another object of the invention is to provide a closed-loop cooling system which uses a venturi and pressure switch combination, rather than a differential pressure switch, to facilitate controlling cooling of one or more components in the system.

Another object of the invention is to provide a closed-loop system having a venturi whose throat is set at a predetermined pressure, such as atmospheric pressure so that the venturi can provide means for controlling cooling of the heat-generating component in the system.

Still another object of the invention is to provide a circular venturi which reduces the overall axial length of the venturi by providing a venturi passageway which flows about the axis of the venturi.

In one aspect, the invention comprises a venturi having a first wall that lies in a first plane, said first wall comprising an outlet opening, a second wall that lies in a second plane substantially parallel to said first plane, a third wall situated between the first and second walls, the third wall lying in a third plane that is substantially perpendicular to the first plane, the third wall comprising an inlet opening and a throat opening; a fourth wall situated between the outlet opening and the third wall, the fourth wall having a first end secured to the third wall adjacent the inlet opening; the first, second, third and fourth walls cooperating to define a venturi passageway from the inlet opening, past the throat opening to the outlet opening.

Yet another aspect of this invention comprises a cooling system for cooling a component comprising a heat rejection component, a pump for pumping fluid to the heat-rejection component and the component, the pump comprising a venturi comprising a venturi inlet coupled to an outlet of the pump; the venturi comprising a first wall that lies in a first plane, the first wall comprising the venturi outlet, a second wall that lies in a second plane substantially parallel to the first plane, a third wall situated between the first and second walls, the third wall lying in a third plane that is substantially perpendicular to the first plane, the third wall comprising an inlet opening and a throat opening, a fourth wall situated between the venturi outlet and the third wall, the fourth wall having a first end secured to the third wall adjacent the inlet opening; the first, second, third and fourth walls cooperating to define a venturi passageway from the venturi inlet, past the throat opening to the venturi outlet opening, a conduit for communicating fluid among at least the component, the heat-rejection component and the pump.

Still another aspect of this invention comprises an x-ray system comprising an x-ray apparatus for generating x-rays, the x-ray apparatus comprising an x-ray tube situated in an x-ray tube casing and a cooling system for cooling the x-ray tube; the cooling system comprising a heat-rejection component coupled to the x-ray tube casing, a pump for pumping fluid to the heat-rejection component and the component; the pump comprising a conduit comprising a venturi having a predetermined pressure applied at a throat of the venturi, a conduit for communicating fluid among the x-ray tube casing, the heat-rejection component and the pump, the venturi comprising a first wall that lies in a first plane, the first wall comprising a venturi outlet, a second wall that lies in a second plane substantially parallel to the first plane, a third wall that lies in a third plane between the first and second walls, the third plane being generally circular and substantially perpendicular to the first and second planes, the third wall comprising an inlet opening and a throat opening, a fourth wall situated between the venturi outlet and the third wall, the fourth wall having a first end secured to said third wall adjacent the inlet opening, the first, second, third and fourth walls cooperating to define a venturi passageway from the venturi inlet, past the throat opening to the venturi outlet.

Yet another aspect of this invention comprises a venturi comprising a substantially planar first wall having a venturi outlet opening, a second wall coupled to the first wall and defining a cylindrical area, the second wall comprising a venturi inlet opening and a throat opening, a third wall situated within the cylindrical area and coupled to the substantially planar first wall in opposed relation to the second wall, the third wall comprising a first end coupled to the first wall adjacent the inlet opening, the substantially planar first wall, the second wall and the third wall cooperating with a fourth wall to define a passageway in communication with the venturi inlet opening, an outlet area at the venturi outlet area and a throat area adjacent the throat opening to define a predetermined pressure.

Yet another aspect of this invention comprises method for cooling a component situated in a system, the method comprising the steps of coupling a component to a pump for pumping a cooling fluid through heat-rejection component, pumping the cooling fluid through a circular venturi having a throat opening subject to a predetermined pressure, and increasing a boiling point of the cooling fluid, thereby increasing an operating temperature of the X-ray system.

Yet another aspect of this invention comprises a pump for pumping fluid comprising a pump motor comprising an axis, a circular venturi coupled to an outlet end of the pump, the circular venturi defining a venturi passageway that flows in a plane about the axis.

These and other objects and advantages of the invention will be apparent from the following description, the appended claims, and the accompanying drawings.

BRIEF DESCRIPTION OF ACCOMPANYING DRAWING

FIG. 5 is a table representing various measurements relative to a given flow diameter at a particular flow rate.

DETAILED DESCRIPTION OF PREFERRED EMBODIMENT

Figure 1:
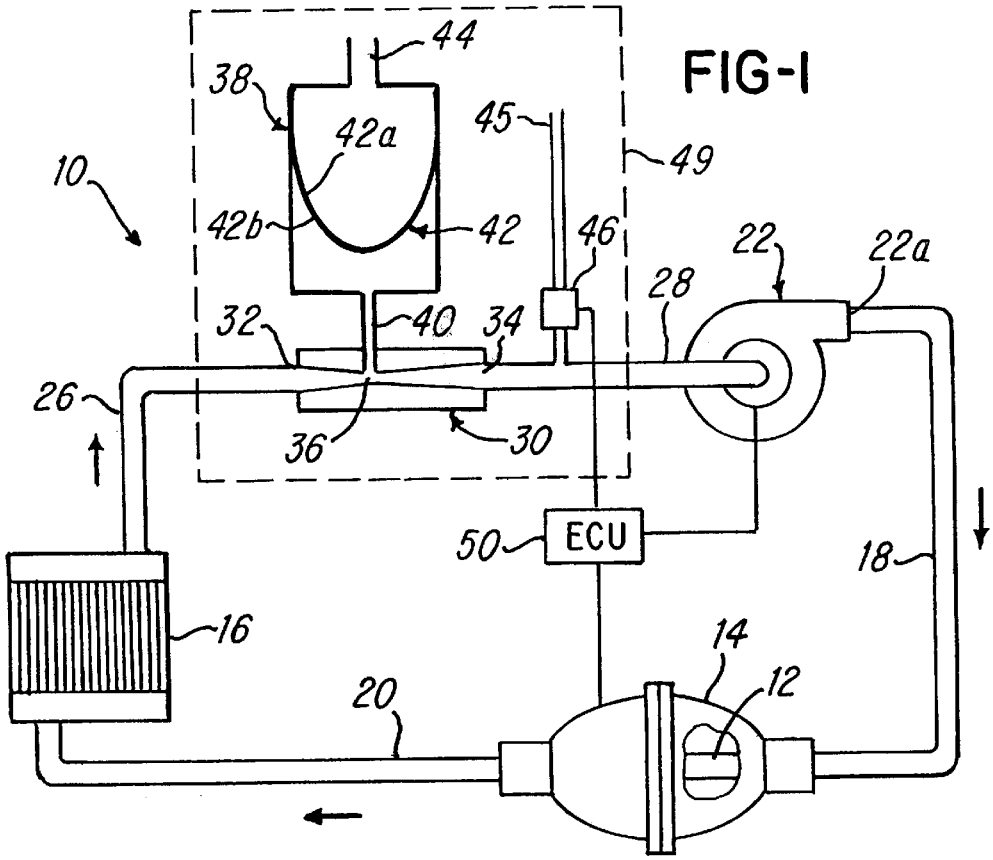
FIG. 1 is a schematic view of a cooling system in accordance with one embodiment of the invention showing a venturi having a throat coupled to an expansion tank or accumulator whose bladder is exposed to atmospheric pressure.

Referring now to FIG. 1, a cooling system 10 is shown for cooling a component 12. While one embodiment of the invention will be described herein relative to a cooling system for cooling the X-ray tube 12 situated inside a housing 14. It should be appreciated that the features of the invention may be used for cooling any heat-generating component in the closed-loop system 10.

As mentioned, the cooling system 10 comprises a heat-generating component, such as the X-ray tube 12, and a heat exchanger or heat-rejection component 16, which in the embodiment being described is a heat exchanger available from Lytron of Woburn, Mass.

The system 10 further comprises a fluid pump 22 which is coupled to housing 14 via conduit 18. In the embodiment being described, the pump 22 pumps fluid, such as a coolant, through the various conduits and components of system 10 in order to cool the components 12. It has been found that one suitable pump 22 is the pump Model No. H0060.2A-11 available from Tark. Inc. of Dayton, Ohio. In the embodiment being described, the pump 22 is capable of pumping on the order of between 0 and 10 gallons per minute, but it should be appreciated that other size pumps may be provided, depending on the cooling requirements, size of the conduits in the system 10 and the like.

In the embodiment being described, the throat 36 of venturi 30 is subject to a predetermined pressure, such as atmospheric pressure. This predetermined pressure is selected to facilitate increasing the fluid pressure in the system 10 which, in turn, facilitates increasing a boiling point of the fluid which has been found to facilitate reducing or preventing cavitation in the pump 22.

Figure 2:
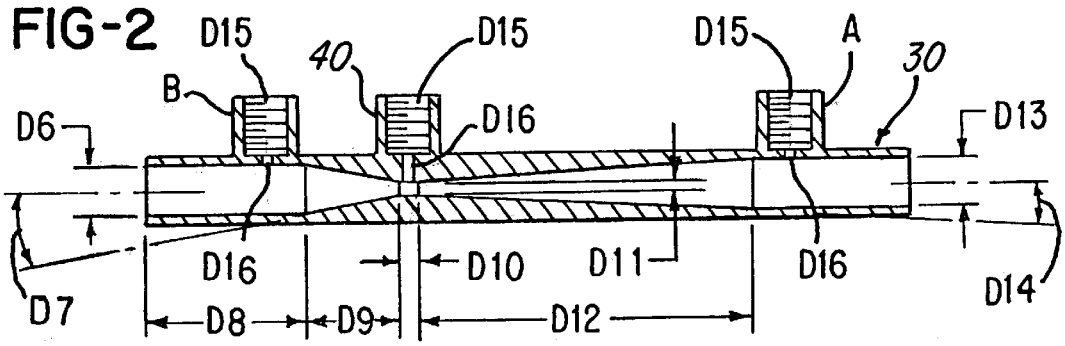
FIG. 2 is a sectional view of the venturi shown in FIG. 1.

The system 10 further comprises a venturi 30 having an inlet end 32, an outlet end 34 and a throat 36. For ease of description, the venturi 30 is shown in FIG. 2 as having downstream port A, upstream port B, and throat port 40 that are described later herein. The venturi 30 is coupled to heat-rejection component 16 via conduit 26 and pump 22 via conduit 28, as illustrated in FIG. 1. In the embodiment being described, the throat 36 of venturi 30 is coupled to an expansion tank or accumulator 38 at an inlet port 40 of the accumulator 38, as shown in FIG. 1. The accumulator 38 comprises a bladder 42 having a first side 42*a* exposed to atmosphere via port 44. A second side 42*b* of bladder 42 is exposed or subject to pressure Pt, which is the pressure at the throat 36 of venturi 30, which is also atmospheric.

An advantage of this invention is that the venturi causes higher pressures and, therefore, a higher operating fluid temperature without boiling. This creates a larger temperature differential that maximizes the heat transfer capabilities of heat exchanger 16. Stated another way, raising a boiling point of the fluid in the system 10 permits higher fluid temperatures, which maximizes the heat exchanging capability of heat exchanger 16. These features of the invention will be explored later herein.

The system 10 further comprises a switch 46 situated adjacent (at port A in FIG. 2) venturi 30 in conduit 28, as illustrated in FIG. 1. In the embodiment shown in FIG. 1, the switch 46 is a non-differential pressure switch 46 that is located downstream of the venturi 30, but upstream of pump 22, but it could be situated upstream of venturi 30 (at port B illustrated in FIG. 2) if desired. As shown in FIG. 1, the switch is open, via throat 45, to atmosphere and measures fluid pressure relative to atmospheric pressure. Therefore, it should be appreciated that because the pressure Pt at the throat 36 is also at atmospheric pressure, a difference in the pressure at throat 36 compared to the pressure sensed by switch 46 can be determined. This differential pressure is directly proportionally related to the flow in the system 10. Consequently, it provides a measurement of a flow rate in the system 10.

If necessary, either port A or port B may be closed after the switch is situated downstream or upstream, respectively, of said venturi 36. It has been found that the use of the pressure switch, rather than a differential pressure switch, is advantageous because of its economical cost and relatively simple design and performance reliability. It should be appreciated that the switch 46 is coupled to an electronic control unit ("ECU") 50. The switch 46 provides a pressure signal corresponding to a flow rate of the fluid in system 10. As mentioned earlier, the switch 46 may be located either upstream or downstream of the venturi 30. This signal is received by ECU 50, which is coupled to pressure switch 46 and component 12, in order to monitor the temperature of the fluid and flow through component 12 in the system 10. Thus, for example, when a flow rate of the fluid in system 10 is below a predetermined rate, such as 5 GPM. In this embodiment, then ECU 50 may respond by turning component 12 off so that it does not overheat.

Thus, the switch 46 cooperates with venturi 30 to provide, in effect, a pressure differential switch or flow switch which may be used by ECU 50 to monitor and control the temperature and flow rate of the fluid in the closed-loop system 10 in order to control the heating and cooling of component 12. It should also be appreciated that the switch 46 may be a conventional pressure switch, available from Whitman of Bristol, Conn.

The expansion tank or accumulator 38, which is maintained at atmospheric pressure, is connected to the throat 36 of venturi 30, with the venturi 30 connected in series with the main circulating loop of the closed-loop system 10. The venturi 30 and switch 46 cooperate to automatically control the pressure and temperature in the circulating system 10 by monitoring the flow of the fluid in the system 10. The pressure differential between the throat 36 and, for example, the inlet end 32 of venturi 30 remains substantially constant, as long as the flow is substantially constant.

Because the pressure Pt at the throat 36 is held at atmospheric pressure, the subsequent pressure at outlet end 34 may be calculated using the formula (Vt−Ve)2/2 g, where Ve is a velocity of the fluid at, for example, end 34 of venturi 30 and Vt is a velocity of the fluid at the throat 36 of venturi 30.

The ECU 50 may use the determined measurement of flow from switch 46 to cause the component 12 to be turned off or on if the flow rate of the fluid in system 10 is below or above, respectively, a predetermined flow rate. In this regard, switch 46 generates a signal responsive to pressure (and indicative of the flow rate) at end 34. This signal is received by ECU 50, which, in turn, causes the component 12 to be turned off or on as desired. Advantageously, this permits the flow rate of the fluid in the system 10 to be monitored such that if the flow rate decreases, thereby causing the cooling capability of the fluid in the closed-loop system to decrease, then the ECU 50 will respond by shutting the heat-generating component 12 off before it is damaged by excessive heat or before other problems occur resulting from excessive temperatures.

Advantageously, it should be appreciated that the use of the venturi 30 having the throat 36 subject to atmospheric pressure via the expansion tank 38 in combination with the pressure switch 46 provides a convenient and relatively inexpensive way to measure the flow rate of the fluid in the system 10 thereby eliminating the need for a pressure differential switch of the type used in the past. This also provides the ability to monitor the flow rate of the fluid in the closed-loop system 10.

Figure 4:
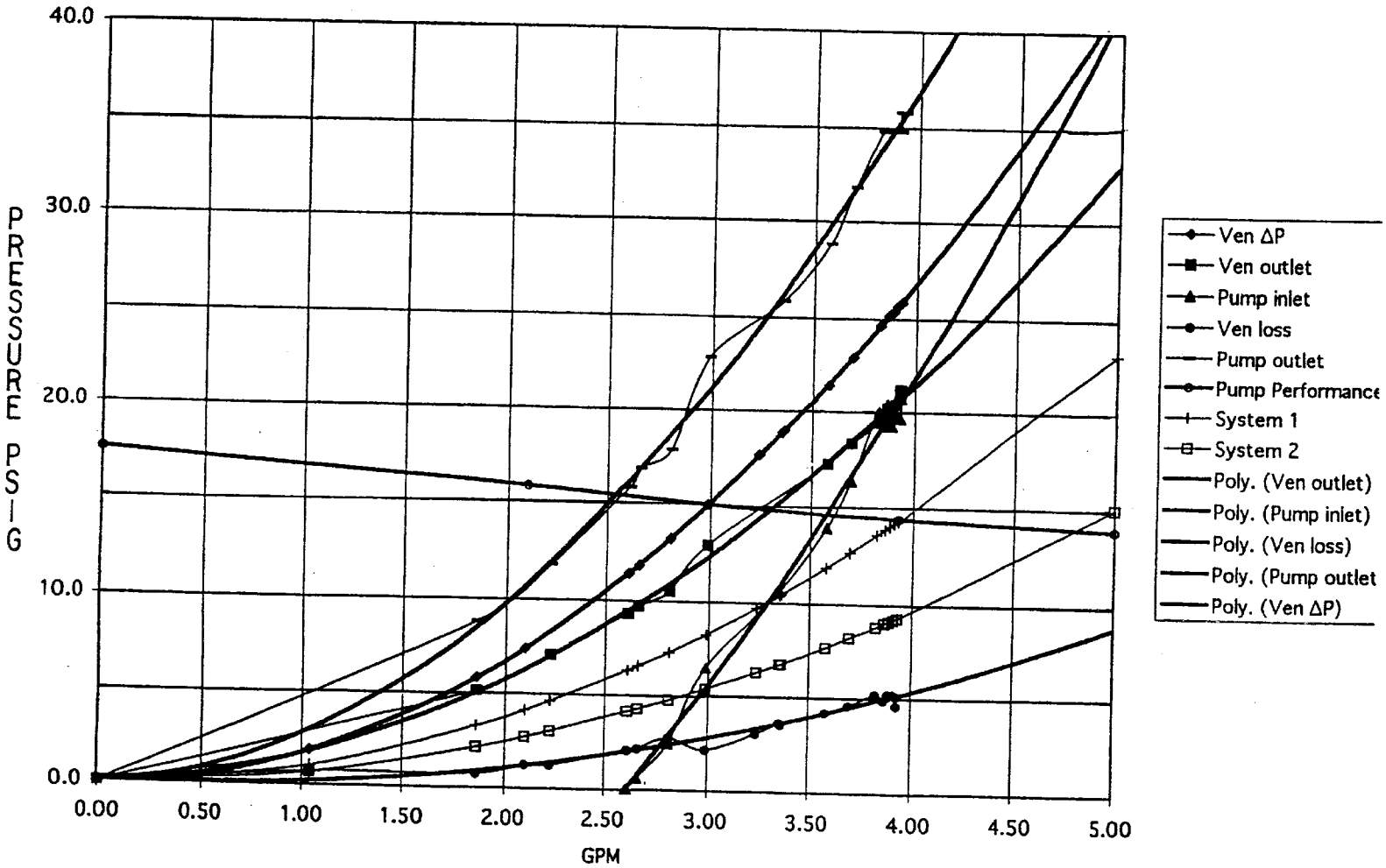
FIG. 4 are plots of the relationship between pressure and flow rate at various points in the system.
Figure 6:
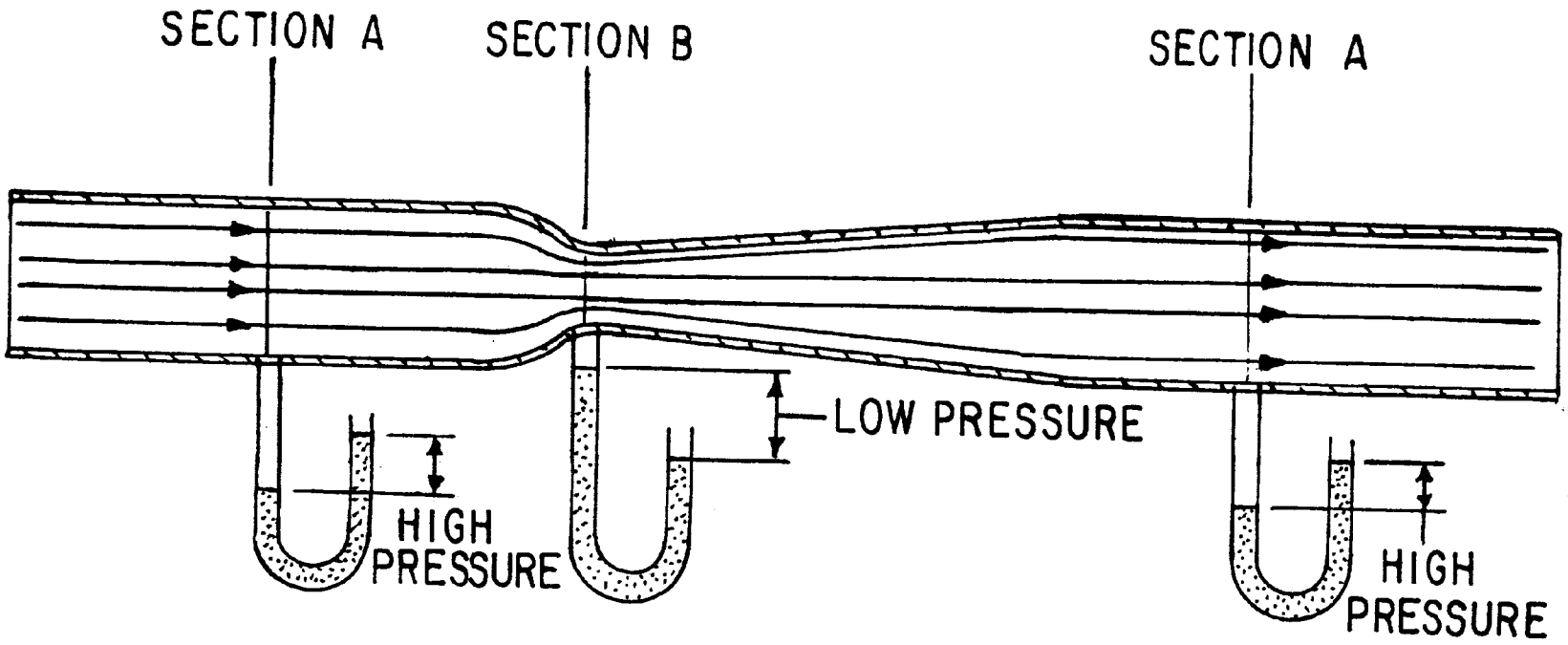
FIG-6 (PRIOR ART)
FIG. 6 is a sectional view of a venturi of the prior art.

FIG. 4 is a diagram illustrating five locations describing various properties of the fluid as it moves through the closed-loop system 10.

Neglecting minor temperature and pressure losses in the conduits 18, 20, 26 and 28. The following Table I gives the relative properties (velocity, gauge pressure, temperature) when a flow rate of the fluid is held constant at four gallons per minute.

TABLE I

| GPM | Location (FIG. 1) | Velocity (fps) | Gage Pressure (psi) | Temperature (F.) |
|---|---|---|---|---|
| 4 | 32 | 8 | 26 | 160 |
| 4 | 36 | 64 | 0 | 160 |
| 4 | 34 | 8 | 24.7 | 160 |
| 4 | 18 | 8 | 40 | 160 |
| 4 | 20 | 8 | 35 | 167 |

The following Table II provides, among other things, different venturi 30 gauge pressures and fluid velocities resulting from flow rates of between zero to 4 gallons per minute in the illustration being described. Note that the pressure at the throat 36 of venturi 30 is always held at atmospheric pressure when the expansion tank 38 is coupled to the throat 36 as illustrated in FIG. 1.

TABLE II

| Location (FIG. 1) Flow rate | 32 Inlet Velocity (ft/sec) | 32 Inlet Pressure (psi) | 36 Throat Velocity (ft/sec) | 36 Throat Pressure (psi) | 34 Outlet Velocity (ft/sec) | 34 Outlet Pressure (psi) |
|---|---|---|---|---|---|---|
| 1 | 2 | 1.7 | 16 | 0 | 2 | 1.6 |
| 2 | 4 | 7 | 32 | 0 | 4 | 6.65 |
| 4 | 8 | 26 | 64 | 0 | 8 | 24.7 |

Note from the Tables I and II that when there is no flow, the fluid pressure throughout the closed-loop system 10 is that of the expansion tank or atmospheric pressure. In the closed-loop system 10, Table I shows the fluid at a minimum pressure at the venturi throat 36 and maximum on a discharge or outlet side 22*a* of pump 22. There is a pressure loss after entering and leaving the heat-generating component 12, such as the X-ray tube, heat exchanger 16 and venturi 30. Velocity is held substantially constant throughout the system 10 because the inner diameter of the conduits 18, 20, 26 and 28 are substantially the same. Fluid velocity changes only when an area of the passage it travels in is either increased or decreased, such as when the fluid is pumped from ends 32 at 34 towards and away from throat 36 of venturi 30.

If the system 10 is assumed to reach a steady state, then a temperature of the fluid in the system 10 will increase from a value before the heat-generating component 12 to a higher value after exiting the heat-generating component 12. The higher temperature fluid will cool back down to the original temperature after exiting the heat exchanger 16, neglecting small temperature changes throughout the conduits 18, 20, 26 and 28 of the system 10.

Figure 3:
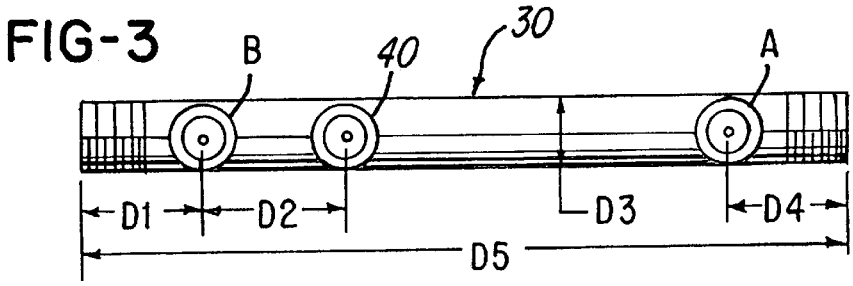
FIG. 3 is a plan view of the venturi shown in FIG. 2.

FIGS. 2 and 3 illustrate various features and measurements of the venturi 30 with the various dimensions at points D1–D16 identified in the following Table III:

TABLE III

| Dimension | Size |
|---|---|
| D1 | 1.5" |
| D2 | 1.71" |
| D3 | 0.84" |
| D4 | 1.5" |
| D5 | 9.5" |
| D6 | 0.622" |
| D7 | 10.5E |
| D8 | 2.0" |
| D9 | 1.172" |
| D10 | 0.2" |
| D11 | 0.188" |
| D12 | 4.145" |
| D13 | 0.622" |
| D14 | 3E |
| D15 | ¼" NPIF hole at 3 locations |
| D16 | 0.1" through hole at 3 locations concentric with D15 holes |

It should be appreciated that the values represented in Table III are merely representative for the embodiment being described.

Table IV in FIG. 5 is an illustration of the results of another venturi 30 (not shown) at various flow rates using varying flow rate diameters at the throat 36 (represented by dimension D11 in FIG. 2).

It should be appreciated that by holding the pressure at the throat 36 at the predetermined pressure, which in the embodiment being described is atmospheric pressure, the velocity of the fluid exiting end 34 of venturi 30 can be consistently and accurately determined using the pressure switch 46, rather than a differential pressure switch (now shown) which operates off a differential pressure between the throat 36 and the inlet end 32 or outlet end 34. Instead of using a differential pressure device (not shown) to measure flow in the system, the expansion tank, when attached to the throat 36 of venturi 30, causes the fluid in the system 10 to be at atmospheric pressure when there is zero flow. For any given flow rate, the pressure at the throat 36 of venturi 30 remains at atmospheric pressure, but a fluid velocity is developed for each cross-sectional area in the closed-loop system 10. Since the venturi throat 36 of venturi 30 is smaller than the venturi inlet 32 and the venturi outlet 34, the velocity at the throat will be higher than the velocity at the inlet 32 or outlet 34. This velocity difference creates a pressure difference between the venturi throat 36 and the ends 32 and 34, which mandates that the pressure at the throat 36 be lower than the pressure at the ends 32 and 34. Stated another way, the pressure at the ends 32 and 34 must be higher than the pressure at the throat 36 which is held at atmospheric pressure.

Consequently, the pressure at the ends 32 and 34 must be greater than atmospheric pressure when there is flow in the system 10. This phenomenon causes the overall pressure in the system 10 to increase, which in effect, raises the effective boiling point of the fluid in the system 10. Because the boiling point of the fluid in the system 10 has been raised, this facilitates avoid cavitation in the pump 22 which occurs when the fluid in the system 10 achieves its boiling point.

Another feature of the invention is that because the boiling point of the fluid is effectively raised in the closed-loop system 10, the higher fluid temperature creates a larger temperature differential and enhances heat transfer for a given size heat exchanger 16. In the embodiment being described, the specific volume of vaporized fluid is reduced by an increase in the system pressure. By way of example, water's specific volume is 11.9 ft.3/lbs. at 35 psia and 26.8 ft.3/lbs. at atmospheric pressure. Thus, increasing the system pressure results in a reduction of the specific volume of the vaporized fluid. In the embodiment being described, the fluid is a liquid such as water, but it may be any suitable fluid-cooling medium, such as ethylene glycol and water, oil or other heat transfer fluids, such as Syltherm available from Dow Chemical.

Advantageously, the higher pressure enabled by venturi 30 permits the use of a simple pressure switch 46 to act as a flow switch. This switch 46 could be placed at the venturi outlet 34 (for example, at port A in FIG. 2), as illustrated in FIG. 1, or at the inlet 32 (for example, at port B in FIG. 2).

Note that a single pressure switch whose reference is atmospheric pressure is preferable. Because its pressure is atmospheric pressure, it does not need to be coupled to the throat 36, which is also at atmospheric pressure. Once the pressure is determined at the outlet 34 or inlet 32, a flow rate can be calculated using the formula mentioned earlier herein, thereby eliminating a need for a differential pressure switch of the type used in the past. A method for increasing pressure in the closed-loop system 10 will now be described.

The method comprises the steps of situating the venturi in the closed-loop system 10. In the embodiment being described, the venturi is situated in series in the system 10 as shown.

A predetermined pressure, such as atmospheric pressure in the embodiment being described, is then established at the throat 36 of the venturi 30. The method further uses the pump 22 to cause flow in the system 10 in order to increase pressure in the system, thereby increasing a flow rate of the fluid in the system 10 such that the pressure at the inlet 32 and outlet 34 relative to the throat 36, which is held at a predetermined pressure, such as atmospheric pressure, is caused to be increased.

In the embodiment being described, the predetermined pressure at the throat 36 is established to be the atmospheric pressure, but it should be appreciated that a pressure other than atmospheric pressure may be used, depending on the pressures desired in the system 10. Advantageously, this system and method provides an improved means for cooling a heat-generating component utilizing a simple pressure switch 46 and venturi 30 combination to provide, in effect, a switch for generating a signal when a flow rate achieves a predetermined rate. This signal may be received by ECU 50, and in turn, used to control the operation of heat-generating component 12 to ensure that the heat-generating component 12 does not overheat.

Figure 8:
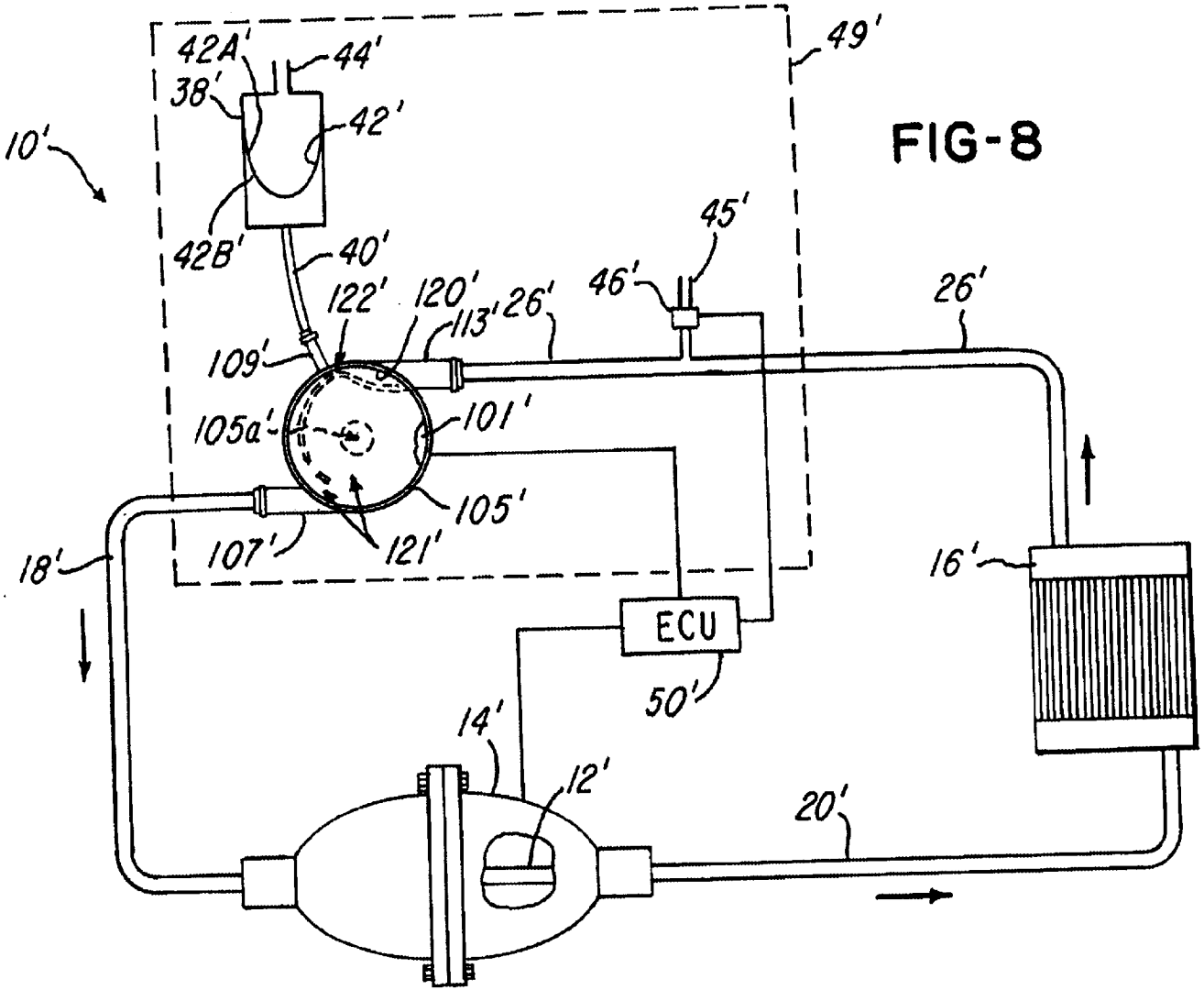
FIG. 8 is a schematic view of a cooling system in accordance with a second embodiment of the invention showing a circular venturi.
Figure 10:
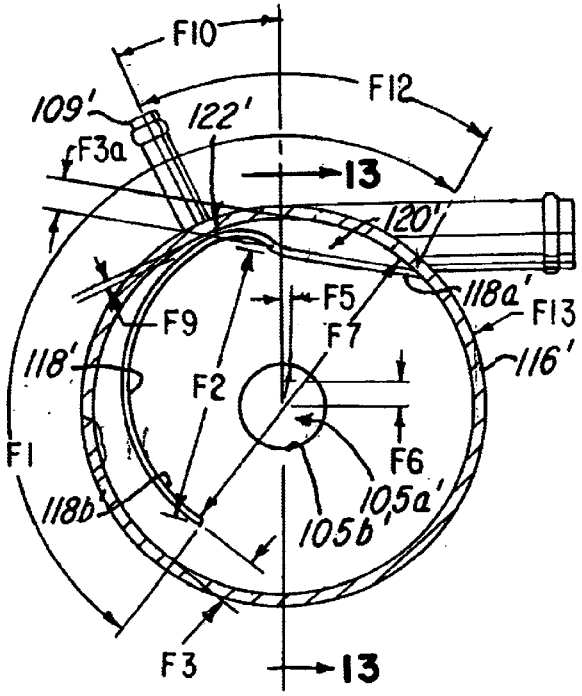
FIG. 10 is a view taken in the direction of arrow P in FIG. 9, showing details of the circular venturi and venturi wall.
Figure 11:
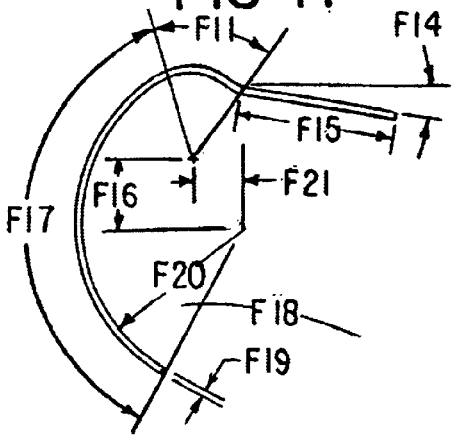
FIG. 11 is a view of the venturi wall.
Figure 12:
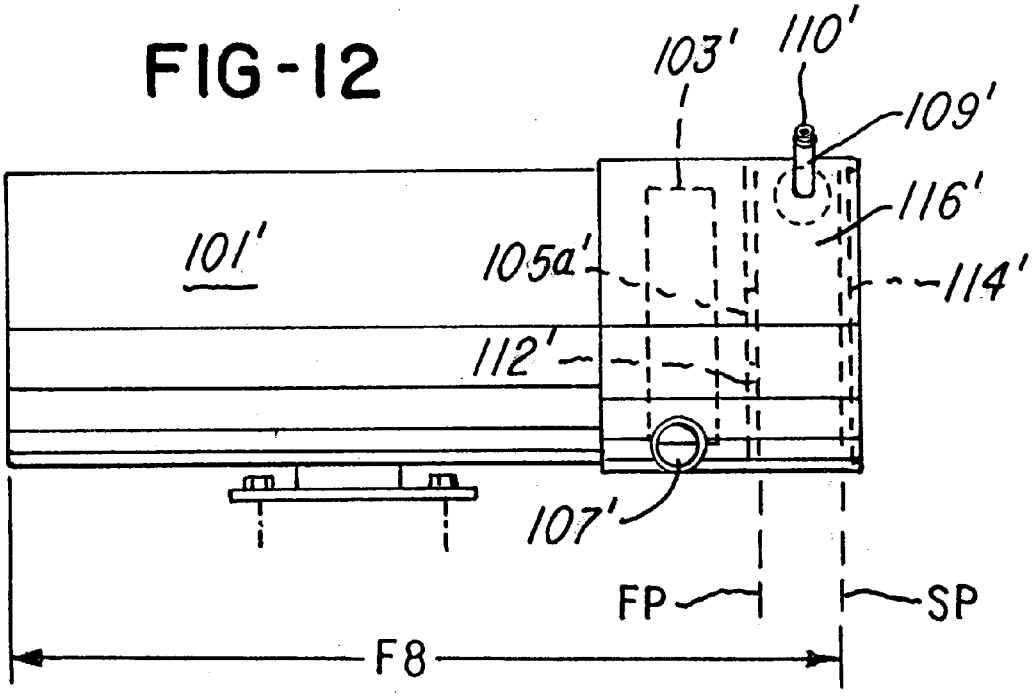
FIG. 12 is a view of the motor and circular venturi, illustrating the compactness of the embodiment.

Referring to FIGS. 8–13 another embodiment of the invention is illustrated wherein like elements to those described with reference to the previous embodiment are labeled with the same reference numerals, except that a prime ("') mark has been added to the numerals shown in FIGS. 8–13. As illustrated in FIGS. 8 and 12, the system 10' comprises a fluid pump 101' having an impeller 103' (FIG. 12) for pumping fluid, such as a coolant, received from an inlet conduit 113', through an opening or outlet 105*a*' of a circular venturi 105', and through an outlet conduit 107'.

In the embodiment being described, the circular venturi 105' comprises an inlet conduit 113' receives fluid from the conduit 26' and from the heat-rejection component 16', as best illustrated in FIG. 8. The circular venturi 105' further comprises a throat conduit 109' (FIGS. 8, 9 and 10) that defines a throat opening 110'.

Figure 13:
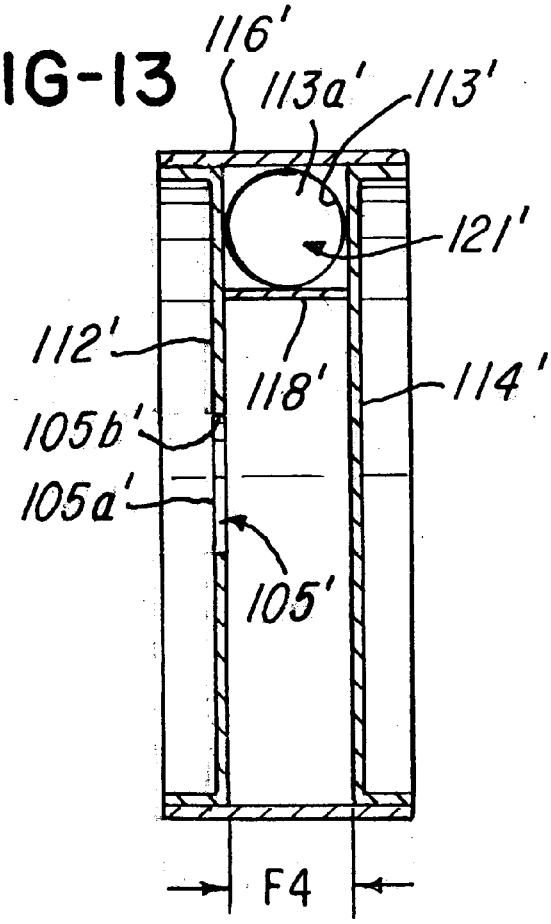
FIG. 13 is a sectional view taken along the line 13—13 in FIG. 10.

As best illustrated in FIGS. 12 and 13, the circular venturi 105' comprises a first planer wall 112' that lies in a first plane FP (FIG. 12) and a second wall 114' that lies in a second plane SP. Note that the second plane SP is substantially parallel to the first plane FP, as illustrated in FIG. 12.

The circular venturi 105' further comprises a third wall 116', which in the embodiment being defines an outer wall of the venturi 105'. Note that the third wall 116' comprises an inlet opening 113*a*' (FIG. 13) defined by inlet conduit 113' and the throat opening 110' defined by the throat conduit 109'. Note that the third wall 116' lies in a circular plane CP that is substantially perpendicular to the first plane FP and second plane SP as best illustrated in FIG. 9.

Figure 9:
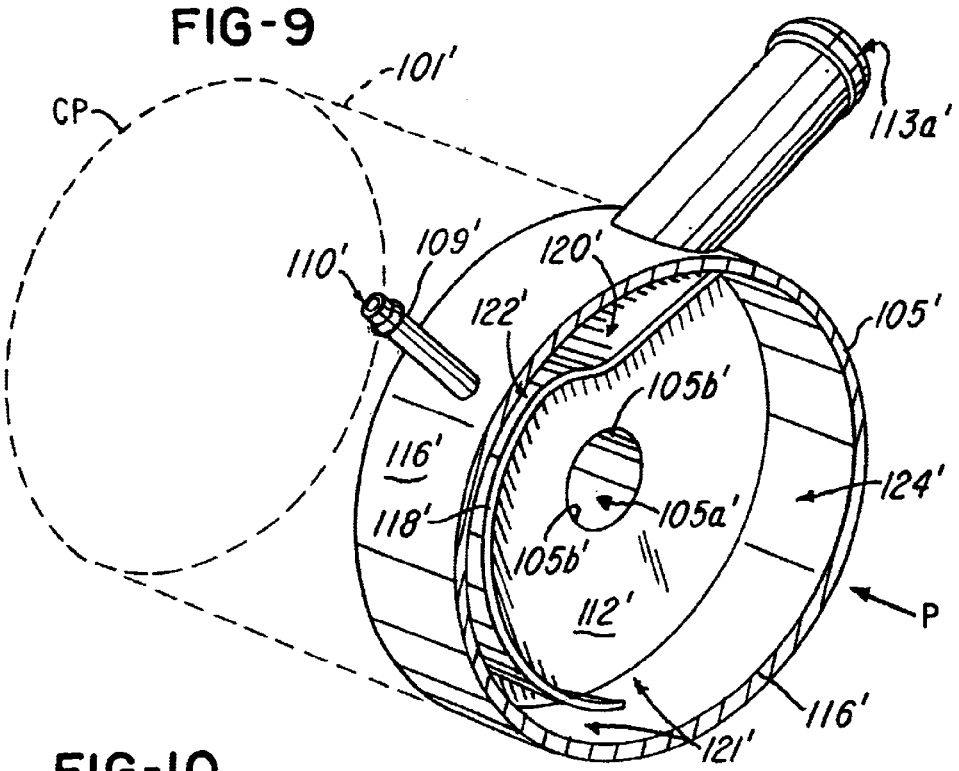
FIG. 9 is a perspective view of the circular venturi.

The venturi 105' further comprises a fourth wall 118' situated between the outlet opening 105*a*' defined by the wall 105*b*' (FIGS. 9 and 13). Notice that the fourth wall 118' has a first end 118*a*' which is coupled to the wall 116' adjacent the inlet opening 113*a*' defined by the inlet conduit 113', as best illustrated in FIGS. 9 and 10. Notice that the second end 118*b*' terminates between the wall 116' and outlet opening 105*a*'. Note that the walls 112', 114', 116' and 118' cooperate (as best illustrated in FIGS. 9–11) to define a venturi passageway 121' comprising a venturi inlet area 120', a venturi throat area 122', and venturi outlet area 124'. Note that in the sectional view illustrated in FIG. 13, the venturi passageway 121' is defined by at least a portion of walls 112', 114', 116' and 118' in cross section, when viewed in a direction that is perpendicular to a direction of the fluid flow as defined by the walls 112', 114', 116' and 118'. Thus, it should be appreciated that the fourth wall 118' cooperates with the walls 112'–116' to define the venturi passageway 121' which functions in a manner that is similar to the venturi 30 illustrated in the first embodiments shown in FIGS. 1–7. In this embodiment, the conduits 107', 109', 113' and the walls 112'–116' are fastened, secured or fixed together by suitable means, such as welding or any other suitable means. Once assembled, the venturi 105' is situated into the system 10', as illustrated in FIG. 8.

As best illustrated in FIG. 8, the throat conduit 109' is coupled to the accumulator 38' which functions in the manner described earlier herein relative to the embodiment described in FIGS. 1–7. The system 10' of the embodiment described in FIGS. 8–13 comprises the switch 46' and ECU 50', which is coupled to the switch 46', motor 101', and the heat-generating component, such as the x-ray tube 112'. The ECU 50' may use the determined measurement of flow from switch 46' to cause the component 12' to be turned off or on if the flow rate of the fluid in system 10' is below or above, respectively, a predetermined flow rate. In this regard, switch 46' generates a signal responsive to pressure (and indicative of the flow rate) from the heat-rejection component 16'. This signal is received by ECU 50' which, in turn, causes the component 12' to be turned off or on as desired. As with the embodiment described earlier herein, this permits the flow rate of the fluid in the system 10' to be monitored such that if the flow rate decreases, thereby causing the cooling capability of the fluid in the closed-loop system 10' to decrease, then the ECU 50' will respond by shutting the heat-generating component 12' off before it is damaged by excessive heat or before other problems occur resulting from excessive temperatures.

In this embodiment, the throat area 122' of venturi 105' is subject to a predetermined pressure, such as atmospheric pressure through accumulator 38'. This predetermined pressure is selected to facilitate increasing the fluid pressure in the system 10' which, in turn, facilitates controlling a boiling point of the fluid in the system 10'. Controlling the boiling point facilitates reducing or preventing cavitation in the pump 101'.

As with the embodiment described earlier herein, the throat area 122' of venturi 105' is coupled to the expansion tank or accumulator 38' at an inlet port 40' of the accumulator 38' which is coupled to the throat conduit 109', as best illustrated in FIG. 8. The accumulator 38' comprises a bladder 42' having a first side 42*a*' exposed to atmosphere via port 44'. A second side 42*b*' of bladder 42' is exposed or subject to pressure PT2 which is the pressure at the throat 122' of the venturi 105'.

As mentioned earlier, the system 10' comprises the switch 46' that is situated between the inlet conduit 113' and the heat-rejection component 16' in the embodiment now being described and as illustrated in FIG. 8. It should be appreciated that, as with the embodiment described earlier herein, the switch 46' is a non-differential pressure switch 46' that is located upstream of the venturi 105', but downstream of the heat-rejection component 16', but it could be situated downstream of the venturi 105 ', if desired. As shown in FIG. 8, the switch 46' is open, via throat 45', to atmosphere and measures fluid pressure relative to atmospheric pressure. Therefore, it should be appreciated that because the pressure T2 at the throat 122' is also at atmospheric pressure a difference in the pressure at 122' compared to the pressure sensed by switch 46' can be determined. This pressure differential is directly proportionally related to the flow in the system 10'. As with the embodiment described earlier, this provides a measurement of a flow rate in the system 10'.

As with the embodiment described earlier herein, the use of the venturi 105' having the throat 122' subject to atmospheric pressure via the expansion tank 38' in combination with the switch 46' provides a convenient and relatively inexpensive way to measure the flow rate of the fluid in the system 10', thereby eliminating the need for pressure differential switch of the type used in the past. This also provides the ability to monitor the flow rate in the closed-loop system 10' to shut down the heat-generating component in the system 10' if necessary. For ease of illustration, minor temperature and pressure losses in the conduits 18', 20', and 26' the following Table IV gives the relative properties (velocity, gauge pressure, temperature) when a flow rate of a fluid is held constant at 4 gallons per minute:

TABLE IV

| GPM | Location (FIG. 8) | Velocity (fps) | Gage Pressure (psi) | Temperature (F.) |
|---|---|---|---|---|
| 4 | 120' | 5.5 | 15 | 160° F. |
| 4 | 122' | 47.0 | 0 | 160° F. |
| 4 | 121' | 5.5 | 12 | 160° F. |
| 4 | 107' | 5.3 | 27 | 160° F. |
| 4 | 20' | 5.3 | 23 | 160° F. |

The following Table V provides, among other things, different venturi 105' gauge pressure and fluid velocities resulting from flow rates of between 0–4 gallons per minute in the illustration being described. Note that the pressure at the throat 122' of venturi 105' is always held at atmospheric pressure in the expansion tank 38' is throat 122' as illustrated in FIG. 8.

TABLE V

| Location (FIG. 8) Flow rate | 120' Inlet Velocity (ft/sec) | 120' Inlet Pressure (psi) | 122' Throat Velocity (ft/sec) | 122' Throat Pressure (psi) | 121' Outlet Velocity (ft/sec) | 121' Outlet Pressure (psi) |
|---|---|---|---|---|---|---|
| 1 | 1.3 | 1 | 12 | 0 | 1.3 | 1.0 |
| 2 | 2.6 | 4 | 24 | 0 | 2.6 | 3.0 |
| 4 | 5.5 | 15 | 47 | 0 | 5.5 | 12 |

Note from the Tables IV and V that when there is no flow, the fluid pressure throughout the closed-loop system 10' is that of the expansion tank or atmospheric pressure. In the closed-loop system 10' the Table IV shows the fluid at a minimum pressure at the venturi throat 122', and a maximum on a discharge or outlet end 107' of pump 101'. There is a pressure loss after entering and leaving the heat-generating component 12' such as the x-ray tube heat exchanger 16', and venturi 105'. Velocity is held substantially constant throughout the system 10' because an inner diameter of the conduits 18', 20', 26', conduits 107' and 109' and diameter of wall 105*b*' (FIG. 9) are substantially the same. The fluid velocity changes only when an area of the passage it travels in is either increased or decreased, such as when the fluid is pumped between conduits 107' and 113' towards and away from throat 122' of venturi 105'.

FIGS. 10 and 11 illustrate features and dimensions of the venturi 105' at various points F1–F21 identified in the following Table VI:

TABLE VI

| Dimension | Size |
|---|---|
| F1 | 164° |
| F2 | 2.42" |
| F3 | 0.37" |
| F3a | 0.37" |
| F4 | 0.63" |
| F5 | 0.07" |
| F6 | 0.19" |
| F7 | 2.90" |
| F8 | 8.33" |
| F9 | 0.043" |
| F10 | 25° |
| F11 | 68° |
| F12 | 76° |
| F13 | 3.50" dia. |
| F14 | 10° |

TABLE VI-continued

| Dimension | Size |
|---|---|
| F15 | 1.34" |
| F16 | 0.70" |
| F17 | 117° |
| F19 | 0.05" |
| F20 | 1.51" |
| F21 | 0.55" |

It should be appreciated that the values represented in Table VI are merely representative for the embodiment being described.

As with the embodiment described earlier herein, note that by holding the pressure at the throat 122' at the predetermined pressure, which in the embodiment being described is atmospheric pressure, the velocity of the fluid entering conduit 113' at venturi 105' can be consistently and accurately determined using the pressure switch 46', rather than a differential switch (not shown) which operates off a differential pressure between the throat 122' and the inlet conduit 113' and venturi outlet 105*a*'. Consequently, the pressure at the outlet 105*a*' and inlet conduit 113' must be greater than atmospheric pressure when there is flow in the system 10'. As mentioned earlier, this phenomenon causes the overall pressure system in the system 10' to increase, which in effect, raises the effective boiling point of fluid in the system 10'. Because the boiling point of the fluid in the system 10' has been raised, this facilitates avoiding cavitation in the pump 101', which can occur when the fluid in the system 10' achieves its boiling point. As with the embodiment described earlier, another feature of the invention is that because the boiling point of the fluid is effectively raised in the closed-loop system 10', the higher fluid temperature creates a larger temperature differential and enhances heat transfer for a given size exchanger 16'. In the embodiment being described, the specific volume of vaporized fluid is reduced by an increase in the system pressure which results in a reduction of the specific volume of the vaporized fluid, as explained earlier herein.

In the embodiment being described, the fluid is a liquid such as water, but may be any suitable fluid-cooling medium, such as ethylene glycol and water, oil, water or other heat transfer fluids, such as Syltherm available from Dow Chemical. Also, the pump 101' is a Model No. HDD60.8A-11 available from Tark, Inc. Advantageously, the higher pressure enabled by venturi 30' permits the use of a single pressure switch 46' to act as a flow switch.

Advantageously, providing a circular venturi having a venturi passageway of flow path that flows about an axis of the pump 101' provides a convenient means and method for reducing the overall space requirements of the pump 101' and the venturi 105' because the length of the venturi 105' is reduced. Thus, note the axial dimension of F4 (FIG. 13) of venturi 105' of the second embodiment is considerably shorter than the axial dimension D5 (FIG. 3). This makes the circular venturi 105' advantageous when axial space requirements of the system 10' are a concern.

Figure 7:
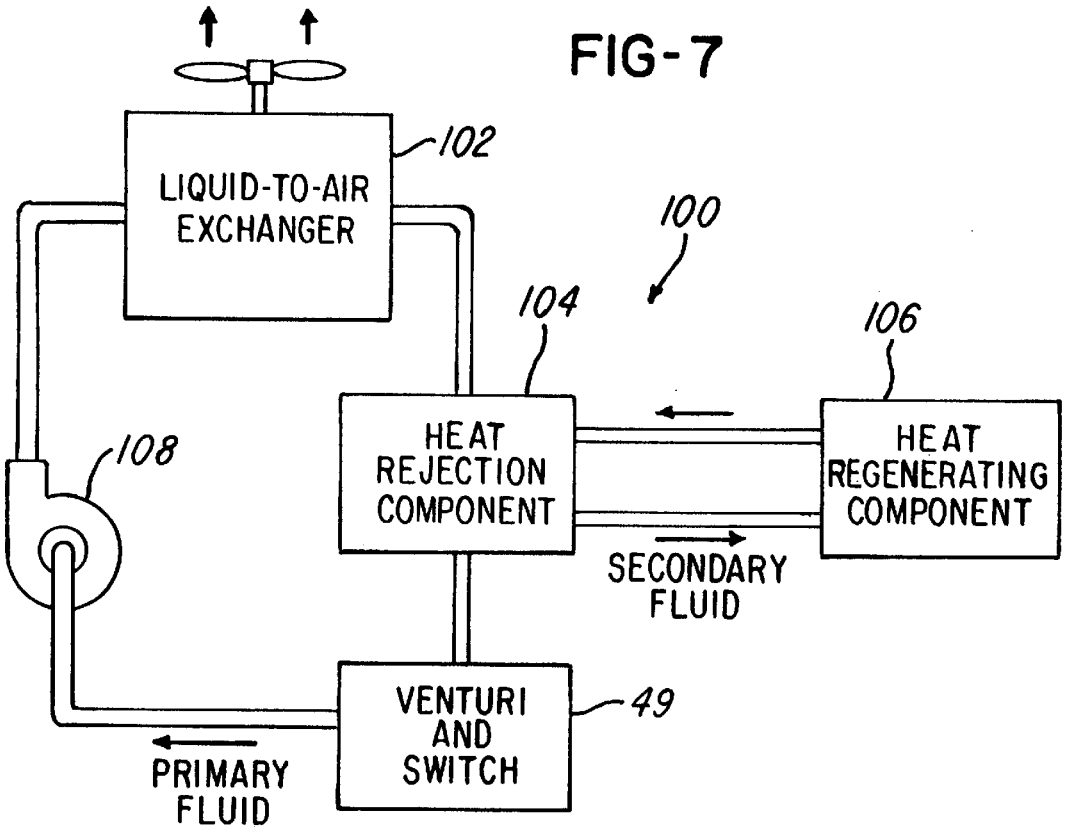
FIG. 7 is a schematic diagram of another embodiment of the invention illustrating use of the venturi in a closed-loop heat exchanger that uses fluid to cool another fluid.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims. For example, while the systems 10 and 10' have been shown and described for use relative to an X-ray cooling system of the type used in, for example, CT Scanners, Diagnostic X-Ray tube used in "C"-Arms, and industrial X-Ray tubes used in non-destructive testing and bomb scanners, it is envisioned that the systems 10 and 10' may be used with an internal combustion engine, cooling system, a hydronic boiler or any closed loop heat exchanger that uses a fluid to cool another fluid. The embodiments illustrated in FIGS. 1–6 and 8–13, may be used with the system 100 illustrated in FIG. 7. As illustrated in FIG. 7, the system 100 comprises a heat exchanger 102, such as a liquid to air heat exchanger, and a liquid-to-liquid heat exchanger 104 for cooling a fluid, such as oil, from a heat-generating component 106. A venturi and switch 49, 49' (FIGS. 1 and 7) couples the heat rejection component 104 to the pump 108. Note that either the venturi 30 or venturi 105' may be provided to achieve the advantages described earlier herein. For example, the venturi 30 of the first embodiment of FIGS. 1–7 or venturi 105' of the embodiment shown in FIGS. 8–13 enables higher system pressure and higher operating fluid temperatures that maximize heat transfer capabilities of heat exchangers 102 and/or 104. This design also facilitates bringing system pressure back to atmospheric pressure at substantially the same time as when the flow rate is reduced to zero.

What is claimed is:

1. A venturi comprising:

a first wall that lies in a first plane, said first wall comprising an outlet opening;

a second wall that lies in a second plane substantially parallel to said first plane;

a third wall situated between said first and second walls, said third wall lying in a third plane that is substantially perpendicular to said first plane, said third wall comprising an inlet opening and a throat opening; and a fourth wall situated between said outlet opening and said third wall, said fourth wall having a first end secured to said third wall adjacent said inlet opening;

said first, second, third and fourth walls cooperating to define a venturi passageway from said inlet opening, past said throat opening to said outlet opening.

2. The venturi as recited in claim 1 wherein said venturi passageway is non-circular in a cross section perpendicular to a direction of fluid flow.

3. The venturi as recited in claim 1 wherein said third plane is generally circular.

4. The venturi as recited in claim 3 wherein said venturi passageway defines a flow path around an axis of said generally circular third plane.

5. The venturi as recited in claim 1 wherein a predetermined pressure is established at said throat opening.

6. The venturi as recited in claim 5 wherein said predetermined pressure is atmospheric pressure.

7. The venturi as recited in claim 5 wherein an expansion tank is situated in communication with said throat opening of said venturi.

8. The venturi as recited in claim 7 wherein said expansion tank comprises a diaphragm having one side in communication with said fluid and an opposite side subject to atmospheric pressure.

9. A cooling system for cooling a component comprising:

a heat rejection component;

a pump for pumping fluid to said heat-rejection component and said component;

said pump comprising a venturi comprising a venturi inlet coupled to an outlet of said pump;

said venturi comprising:

a first wall that lies in a first plane, said first wall comprising said venturi outlet;

a second wall that lies in a second plane substantially parallel to said first plane;

a third wall situated between said first and second walls, said third wall lying in a third plane that is substantially perpendicular to said first plane, said third wall comprising an inlet opening and a throat opening;

a fourth wall situated between said venturi outlet and said third wall, said fourth wall having a first end secured to said third wall adjacent said inlet opening;

said first, second, third and fourth walls cooperating to define a venturi passageway from said venturi inlet, past said throat opening to said venturi outlet opening; and a conduit for communicating fluid among at least said component, said heat-rejection component and said pump.

10. The cooling system as recited in claim 9 wherein said venturi passageway is non-circular in a cross section perpendicular to a direction of fluid flow.

11. The cooling system as recited in claim 10 wherein said venturi passageway defines a flow path that is curved between said venturi inlet and said outlet.

12. The cooling system as recited in claim 9 wherein said inlet opening is not coaxial with said outlet opening.

13. The cooling system as recited in claim 9 wherein said third plane is generally circular.

14. The cooling system as recited in claim 9 wherein a predetermined pressure is established at said throat opening.

15. The cooling system as recited in claim 14 wherein said predetermined pressure is atmospheric pressure.

16. The cooling system as recited in claim 14 wherein an expansion tank is situated in communication with said throat opening of said venturi.

17. An x-ray system comprising:

an x-ray apparatus for generating x-rays, said x-ray apparatus comprising an x-ray tube situated in an x-ray tube casing; and a cooling system for cooling said x-ray tube, said cooling system comprising:

a heat-rejection component coupled to said x-ray tube casing;

a pump for pumping fluid to said heat-rejection component and said component; said pump comprising a said conduit comprising a venturi having a predetermined pressure applied at a throat of said venturi;

a conduit for communicating fluid among said x-ray tube casing, said heat-rejection component and said pump;

said venturi comprising:

a first wall that lies in a first plane, said first wall comprising a venturi outlet;

a second wall that lies in a second plane substantially parallel to said first plane;

a third wall that lies in a third plane between said first and second walls, said third plane being generally circular and substantially perpendicular to said first and second planes, said third wall comprising an inlet opening and a throat opening; and a fourth wall situated between said venturi outlet and said third wall, said fourth wall having a first end secured to said third wall adjacent said inlet opening;

said first, second, third and fourth walls cooperating to define a venturi passageway from said venturi inlet, past said throat opening to said venturi outlet.

18. The x-ray system as recited in claim 17 wherein said venturi passageway is non-circular in a cross section perpendicular to a direction of fluid flow.

19. The x-ray system as recited in claim 18 wherein said venturi passageway defines a flow path that is curved between said venturi inlet and said outlet.

20. The x-ray system as recited in claim 17 wherein said inlet opening is not coaxial with said outlet opening.

21. The x-ray system as recited in claim 17 wherein said third plane is generally circular.

22. The x-ray system as recited in claim 17 wherein a predetermined pressure is established at said throat opening.

23. The x-ray system as recited in claim 22 wherein said predetermined pressure is atmospheric pressure.

24. The x-ray system as recited in claim 22 wherein an expansion tank is situated in communication with said throat opening of said venturi.

25. A venturi comprising:

a substantially planar first wall having a venturi outlet opening;

a second wall coupled to said first wall and defining a cylindrical area, said second wall comprising a venturi inlet opening and a throat opening; and a third wall situated within said cylindrical area and coupled to said substantially planar first wall in opposed relation to said second wall, said third wall comprising a first end coupled to said first wall adjacent said inlet opening;

said substantially planar first wall, said second wall and said third wall cooperating with a fourth wall to define a passageway in communication with said venturi inlet opening, an outlet area at said venturi outlet area and a throat area adjacent said throat opening to define a predetermined pressure.

26. The venturi as recited in claim 25 wherein a predetermined pressure is established at said throat opening.

27. The venturi as recited in claim 26 wherein said predetermined pressure is atmospheric pressure.

28. The venturi as recited in claim 26 wherein said predetermined pressure is provided by an expansion tank in communication with said throat opening of said venturi.

29. The venturi as recited in claim 25 wherein said substantially planar first wall lies in a first plane, said second wall lies in a second plane, and said third wall lies in a third plane, said second and third walls being substantially perpendicular to said first plane.

30. The venturi as recited in claim 25 wherein said fourth wall is defined by a wall in a pump situated adjacent said venturi.

31. The venturi as recited in claim 25 wherein said second wall is substantially cylindrical and comprises an axis, said outlet aperture being situated along said axis and said venturi inlet opening is situated substantially perpendicular to said axis.

32. A method for cooling a component situated in a system; said method comprising the steps of:

coupling a component to a pump for pumping a cooling fluid through a heat-rejection component;

pumping said cooling fluid through a circular venturi having a throat opening subject to a predetermined pressure; and increasing a boiling point of said cooling fluid, thereby increasing an operating temperature of the system.

33. The method as recited in claim 32 wherein said predetermined pressure is atmospheric pressure.

34. The method as recited in claim 32 wherein said method further comprises the step of situating an expansion tank in communication with a throat of said venturi.

35. The method as recited in claim 34 wherein said expansion tank comprises a diaphragm having one side in communication with said fluid and an opposite side subject to atmospheric pressure.

36. The method as recited in claim 32 wherein said method further comprises the step of:

terminating power to said component when a flow of said fluid is less than a minimum flow rate.

37. The method as recited in claim 36 wherein said minimum flow rate is less than about 1 GPM when a velocity of said fluid at the throat of said venturi is at least 16 Ft./Sec.

38. The method as recited in claim 37 wherein said component comprises an X-ray tube.

39. The method as recited in claim 32 wherein said method further comprises the step of:

providing a switch for causing power to said component to be terminated when a flow rate in said conduit is less than a minimum flow rate.

40. The method as recited in claim 39 wherein said switch is a pressure switch.

41. The method as recited in claim 39 wherein when said minimum flow rated is about zero, the pressure in the system goes to atmospheric at substantially the same time.

42. The method as recited in claim 39 wherein a flow switch is situated between an outlet of said venturi and said pump; said method further comprising the step of:

terminating power to said component if a flow rate detected by said flow switch is less than a predetermined flow rate.

43. The method as recited in claim 42 wherein said component comprises an X-ray tube.

44. The method as recited in claim 42 wherein said flow switch comprises a pressure switch coupled to said inlet or outlet of said venturi.

45. The method as recited in claim 32 wherein said component comprises an X-ray tube.

46. A pump for pumping fluid comprising:

a pump comprising an axis; and a circular venturi coupled to an outlet end of said pump, said circular venturi defining a venturi passageway that flows in a plane about said axis;

wherein said circular venturi comprises an inlet opening and an outlet opening, said venturi passageway defines a fluid path that is curved between said inlet opening and said outlet opening.

47. The pump as recited in claim 46 wherein said venturi comprises an inlet opening having an inlet axis and an outlet opening having an outlet axis, wherein said inlet axis is not coaxial with said outlet axis.

48. The pump as recited in claim 46 wherein said inlet opening is not coaxial with said outlet opening.

49. The pump as recited in claim 46 wherein said pump is a centrifugal pump.

50. A pump for pumping fluid comprising:

a pump comprising an axis;

a circular venturi coupled to an outlet end of said pump, said circular venturi defining a venturi passageway that flows in a plane about said axis;

wherein said circular venturi comprises:

a first wall that lies in a first plane, said first wall comprising said venturi outlet;

a second wall that lies in a second plane substantially parallel to said first plane;

a third wall situated between said first and second walls, said third wall lying in a third plane that is substantially perpendicular to said first plane, said third wall comprising an inlet opening and a throat opening;

a fourth wall situated between said venturi outlet and said third wall, said fourth wall having a first end secured to said third wall adjacent said inlet opening;

said first, second, third and fourth walls cooperating to define a venturi passageway from said venturi inlet, past said throat opening to said venturi outlet opening; and a conduit for communicating fluid among at least one component, a heat-rejection component and said pump.

51. The pump as recited in claim 50 wherein said third plane is generally circular.

52. A pump for pumping fluid comprising:

a pump motor comprising an axis; and a circular venturi coupled to an outlet end of said pump, said circular venturi defining a venturi passageway that flows in a plane about said axis;

wherein said venturi passageway is non-circular in a cross section perpendicular to a direction of fluid flow.

53. A pump for pumping fluid comprising:

a pump comprising an axis; and a circular venturi coupled to an outlet end of said pump, said circular venturi defining a venturi passageway that flows in a plane about said axis;

wherein said venturi comprises a throat opening having an associated a predetermined pressure.

54. The pump as recited in claim 53 wherein said predetermined pressure is atmospheric pressure.

55. The pump as recited in claim 53 wherein an expansion tank is situated in communication with said throat opening of said venturi.

* * * * *